US007398616B1

(12) United States Patent
Weir

(10) Patent No.: US 7,398,616 B1
(45) Date of Patent: Jul. 15, 2008

(54) ADJUSTABLE LENGTH HEAVY DUTY BUTT STOCK ASSEMBLY FOR A FIREARM

(76) Inventor: Robert Weir, P.O. Box 191, Chicago Park, CA (US) 95712

( * ) Notice: Subject to any disclaimer, the term of this patent is extended or adjusted under 35 U.S.C. 154(b) by 335 days.

(21) Appl. No.: 11/133,797

(22) Filed: May 21, 2005

Related U.S. Application Data

(60) Provisional application No. 60/574,015, filed on May 21, 2004.

(51) Int. Cl.
*F41C 23/14* (2006.01)

(52) U.S. Cl. ..... 42/73; 42/72; 42/71.01

(58) Field of Classification Search ..... 42/73, 42/75.03, 77, 71.01, 72
See application file for complete search history.

(56) References Cited

U.S. PATENT DOCUMENTS

| | | | | |
|---|---|---|---|---|
| 2,484,168 | A * | 10/1949 | Jachimiec | 42/71.01 |
| 3,137,958 | A * | 6/1964 | Lewis et al. | 42/73 |
| 4,361,326 | A * | 11/1982 | Kokes | 473/206 |
| 5,173,564 | A * | 12/1992 | Hammond, Jr. | 42/75.03 |
| 6,517,133 | B2 * | 2/2003 | Seegmiller et al. | 294/139 |
| 6,543,172 | B1 * | 4/2003 | Armstrong | 42/71.01 |
| 6,560,911 | B2 * | 5/2003 | Sharp | 42/73 |
| 6,641,277 | B2 * | 11/2003 | Smith | 362/111 |
| 6,651,371 | B2 * | 11/2003 | Fitzpatrick et al. | 42/72 |
| 6,779,289 | B2 * | 8/2004 | Kay | 42/75.03 |
| 6,925,744 | B2 * | 8/2005 | Kincel | 42/71.01 |
| 7,152,355 | B2 * | 12/2006 | Fitzpatrick et al. | 42/73 |
| 7,162,822 | B1 * | 1/2007 | Heayn et al. | 42/73 |
| 2002/0050088 | A1 * | 5/2002 | Sharp | 42/73 |
| 2003/0110675 | A1 * | 6/2003 | Garrett et al. | 42/85 |
| 2005/0115134 | A1 * | 6/2005 | Bond et al. | 42/74 |
| 2005/0115140 | A1 * | 6/2005 | Little | 42/118 |
| 2005/0262752 | A1 * | 12/2005 | Robinson et al. | 42/71.01 |

* cited by examiner

*Primary Examiner*—Michael J. Carone
*Assistant Examiner*—Benjamin P Lee
(74) *Attorney, Agent, or Firm*—Stockwell & Smedley, PSC

(57) ABSTRACT

A heavy-duty adjustable length butt stock assembly for a firearm such as an AR15 rifle or any other firearm that is made to accept an AR15 butt stock. The stock is designed to be stronger than any existing production AR15 butt stock. The butt stock has three major components, the butt, the receiver extension tube and the clamping gusset The front end of the butt stock has a primary bore hole that extends inwardly from its front end to the rear end of the butt stock. The receiver extension tube is telescopically received in the primary bore hole. An adjustment push button lock extends inwardly from one of the lateral sides of the butt stock and it actuates locking plunger pin that can mate with various longitudinally spaced transversely extending grooves on the bottom surface of the receiver extension tube. Various sling mount structures can be formed on the butt stock or on a clamping gusset that is removably inserted over the receiver extension tube adjacent its front end.

17 Claims, 6 Drawing Sheets

Fig. 16
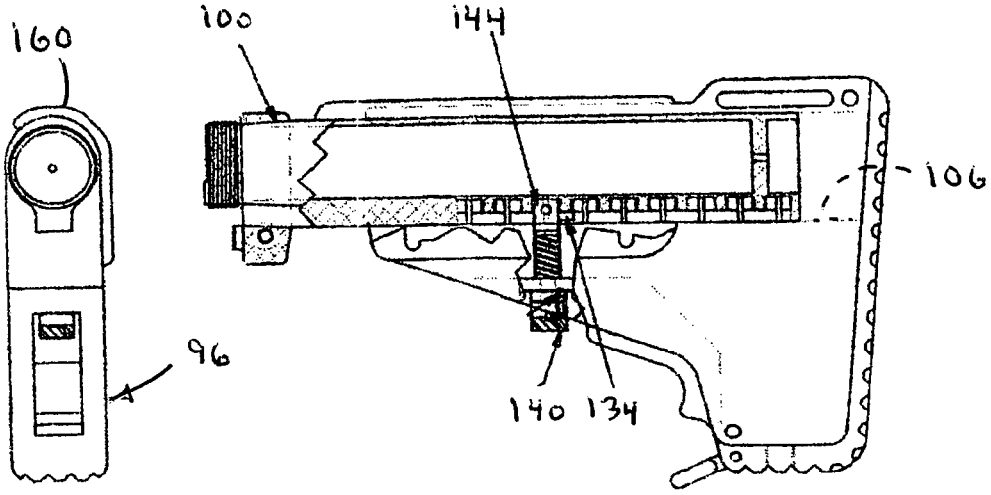
Fig. 17
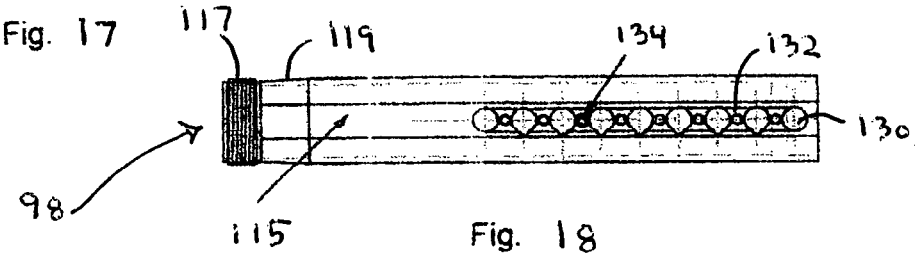
Fig. 18
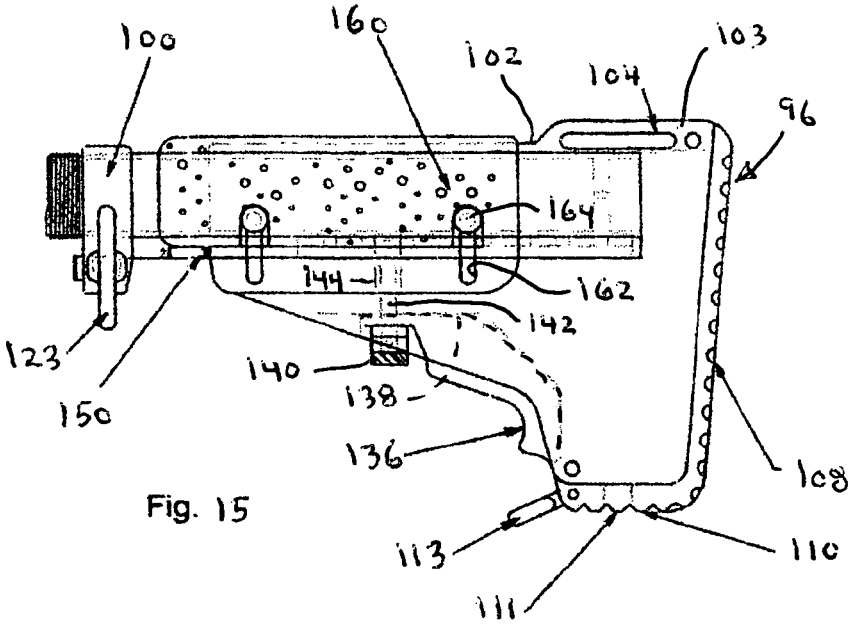
Fig. 15

ADJUSTABLE LENGTH HEAVY DUTY BUTT STOCK ASSEMBLY FOR A FIREARM

This application claims the priority of provisional application 60/574,015 filed May 21, 2004.

BACKGROUND OF THE INVENTION

The invention relates to firearms and more specifically to the AR15 series of rifles and subsequent firearms that are manufactured to receive an AR15 stock.

One of the age old problems that has existed with firearms such as shotguns and rifles is the fact that the physical size of the shooters varies greatly. One solution is to have a shooter buy a butt stock that is custom fitted to the shooter. Another solution is to have an adjustable length butt stock. None of the prior art butt stocks incorporate the unique structure that will be described henceforth.

Another problem exists with the AR15 type rifles; that is, if the receiver extension tube in which the adjustable butt-stock is attached to is bent or slightly damaged, then the AR15 will be disabled when the next round is fired. This aspect brings forth the need for heavy duty receiver extension tube and reinforced receiver.

It is an object of the invention to provide a novel butt stock length push adjustment push button lock having a special spring-loaded tapered locking plunger pin. The tapered locking plunger pin button locks into a corresponding tapered groove in the bottom surface of the receiver extension tube. This feature takes all of the "slop" or "play" out of the adjustable length butt stock assembly.

It is another object of the invention to provide a "countersink gate" around the adjustment push button that reduces the chances of the adjustment push button being accidently released.

It is an additional object of the invention to provide an integrated "battle hammer" integrally formed into the butt stock. The battle hammer feature is intended for hand to hand combat, breaching doors and other utilitarian needs.

It is a further object of the invention to provide a closed cell foam tube fitted to the outer surface of the receive extension tube that insulates the operator from the metal stock and also reduces felt vibration and recoil.

It is also an object of the invention to provide a novel gusset having an integrated sling mount and the gusset clamps to the receiver extension tube. In the second embodiment the clamping gusset screw/sling mount is reversible so that the sling mount can be mounted on either side. The gusset can be axially rotated so that the sling can be mounted on the left or right hand side of the shotgun or rifle. The gusset also reinforces the stock and receiver at its weakest point.

It is another object of the invention to utilize a receiver extension tube whose strength is much greater than existing receiver extension tubes. This feature enables the stock to be much stronger than current stock designs for the AR 15.

It is an additional object of the invention to provide a novel adjustable length butt stock assembly for a firearm that produces an audible click as well as a tactile click when it lines up with the adjustment groove. This indicates to the operator that the length the stock has been adjusted. This feature is especially valuable for low light conditions. Line and adjustment numbers can be applied to the receiver extension tube so that the operator can visually check to see if the stock is properly adjusted for his needs.

SUMMARY OF THE INVENTION

The adjustable length butt stock assembly has been designed for use with firearms such as the AR15 and other weapons. It has two basic structures, an elongated receiver extension tube and a butt stock. The front end of the butt stock has a primary bore hole extending inwardly to the rear wall of the butt stock. The rear end of the elongated receiver extension tube is telescopically received in the front end of the primary bore hole. There is structure for quickly locking and unlocking the receiver extension tube at various longitudinally spaced positions to vary the overall length of the butt stock assembly.

The front end of the receiver extension tube has external threads so that it may be screwed on to the rear end of the receiver of a firearm. A split-ring clamping gusset is slid over the front end of the receiver extension tube to a position just rearwardly of the external threads. The split-ring clamping gusset is then rotated to its desired orientation and tightened in position with a gusset screw. The clamping gusset may have an internal tapered bore that clamps to a receiver extension tube having a corresponding external taper. These corresponding tapered parts apply tension forces to the receiver extension tube when the clamping gusset screw is tightened thereby reinforcing the stock and receiver at its weakest point. The clamping gusset may also have a modular sling mount on one or both sides of the gusset where the following types of slings can be mounted: (1) a single hole type sling can be clipped to either side of the gusset, (2) a 360 degree rotation sling mount for webbing type slings, and (3) a quick detachable sling mount can be installed for clip type or webbing slings.

A "battle hammer" structure is integrally formed into the bottom end of the butt stock. This battle hammer feature is intended for hand to hand combat, breaching doors, and other utilitarian hammering. A foam tube or neoprene cheek rest is applied to the outer surface of the receiver extension tube. This foam or neoprene cheek rest insulates the operator's face from the metal stock and from vibrations.

The butt stock also has a longitudinally extending ridge extending upwardly on its top wall surface that has an elongated groove for attaching a sling thereto. The front wall of the lower portion of the butt stock also has a pair of laterally spaced elongated slots for threading a webbing sling there through.

DESCRIPTION OF THE DRAWINGS

FIG. 15 is a side elevation view of an alternative embodiment of the adjustable length butt stock assembly;

FIG. 16 shows the adjustable length butt stock assembly of FIG. 15 with portions broken away;

FIG. 17 is a front elevation view of the adjustable length butt stock assembly shown in FIG. 16; and FIG. 18 is a bottom plan view of the receiver extension tube.

DESCRIPTION OF THE PREFERRED EMBODIMENT

The adjustable length butt stock assembly will now be described by referring to FIGS. 1-14 of the drawings. The adjustable length butt stock assembly is generally designated numeral 20. Its major parts are butt stock 22, elongated receiver extension tube 24 and rotatable clamping gusset/sling mount 26.

Figure 8:
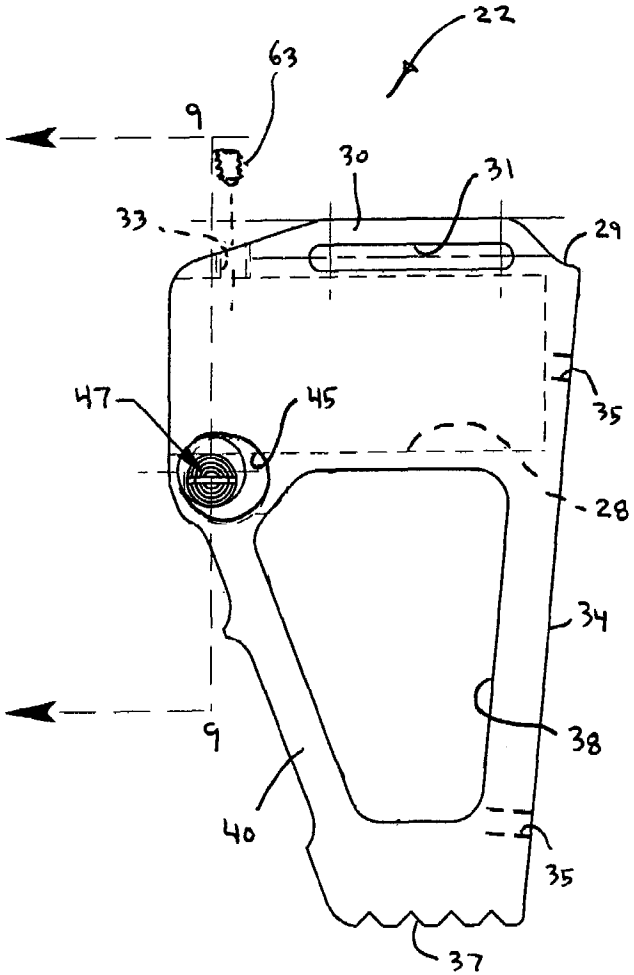
FIG. 8 is an enlarged side elevation view of the butt stock.
Figure 9:
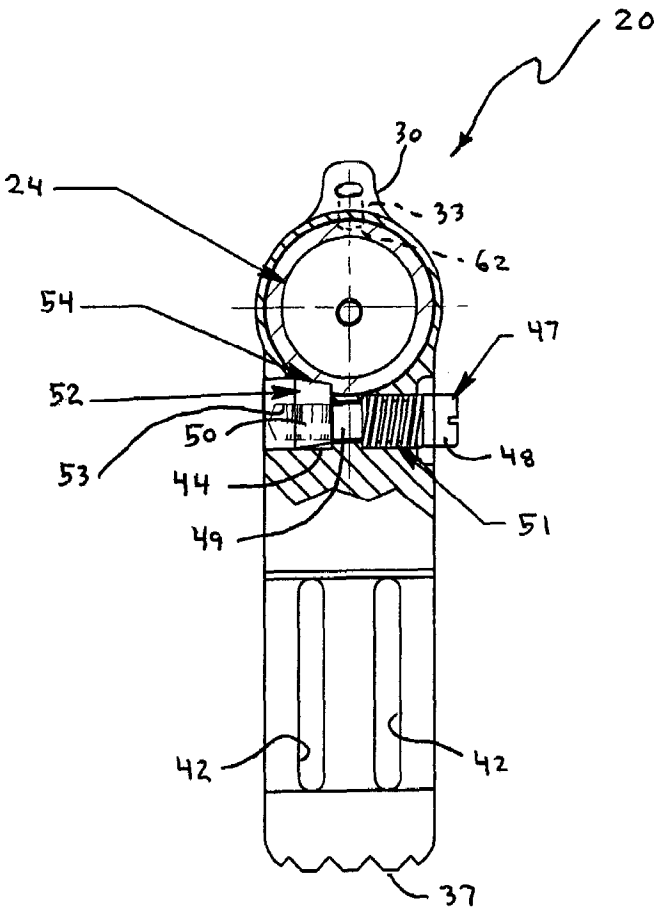
FIG. 9 is a cross sectional view taken along lines 9-9 of FIG. 8.
Figure 12:
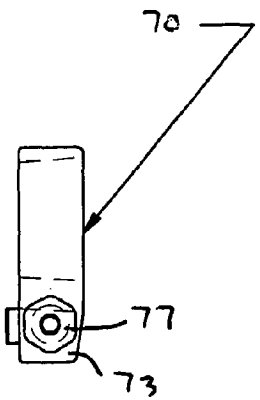
FIG. 12 is a right side elevation view of a clamping gusset illustrated in FIG. 11.
Figure 11:
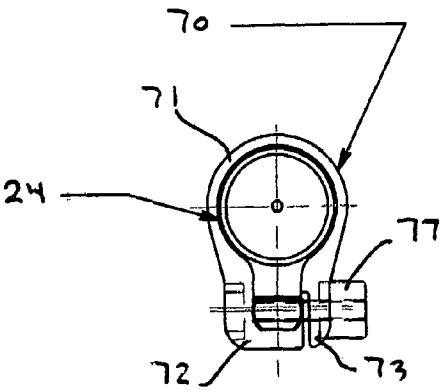
FIG. 11 is an assembled view of the embodiment illustrated in FIG. 10.

The structure of butt stock 22 will be best understood by referring to FIGS. 8 and 9. It has a front end having a primary bore hole 28 extending rearwardly therein. It has a top wall surface 29 that has an upwardly extending ridge member 30 that has a sling mount slot 31 therein. One or more threaded alignment bore holes 33 pass vertically through ridge member 30 and communicate with primary bore hole 28 for a purpose to be discussed later. Rear wall surface 34 has a pair of vertically spaced bore holes 35 that are used for removably securing a butt pad thereto. Bottom surface 37 has a cross hatched hammer surface whose purpose has been discussed previously. An open window structure 38 extends from the left side wall to the right side wall of the butt stock. This forms a front strut frame member 40 and a pair of upright oriented grooves 42 are formed therein for receiving a web sling.

A secondary bore hole 42 passes transversely through butt stock 22 adjacent the bottom end of primary bore hole 28 for removably receiving the push button locking assembly. One end of secondary bore hole 44 has a counter sink surface 45 that reduces the chance of the adjustment button from being accidently depressed. Bush button lock/screw 47 has a head cap 48, a shank portion 49 and a threaded front end 50. An extension spring 51 telescopes over shank portion 49. A tapered locking plunger pin 52 is threaded on to the front end of push button screw 47. Secondary bore hole 44 has an interior outlet port 54 that communicates with the interior of primary bore hole 28. Its purpose will be discussed later.

Figures 1, 2, 3, 4:
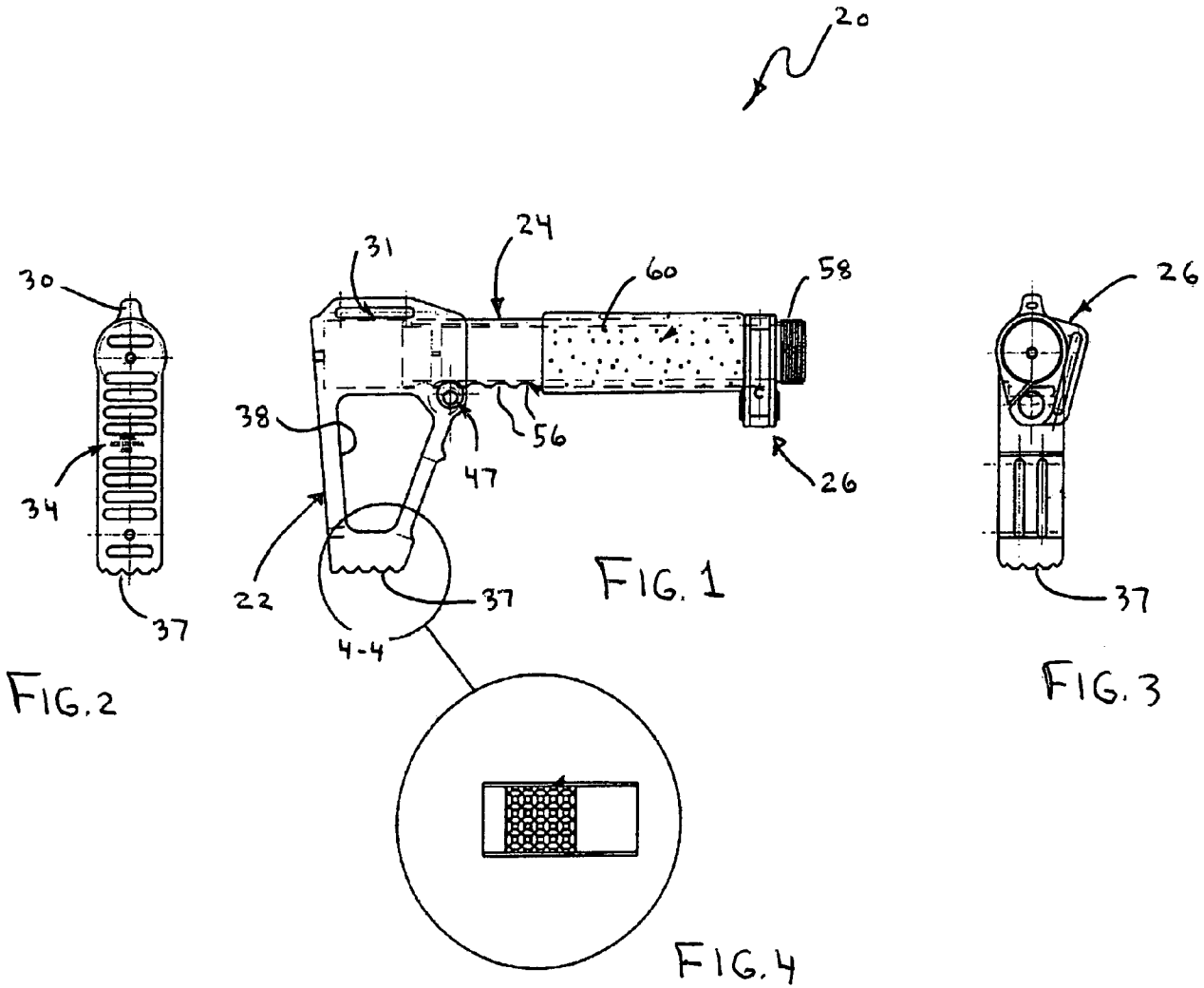
FIG. 1 is an assembled view of the adjustable length butt stock assembly.
FIG. 2 is a rear elevation view thereof.
FIG. 3 is a front end elevation view thereof.
FIG. 4 is a view taken along lines 4-4 of FIG. 1.
Figure 5:
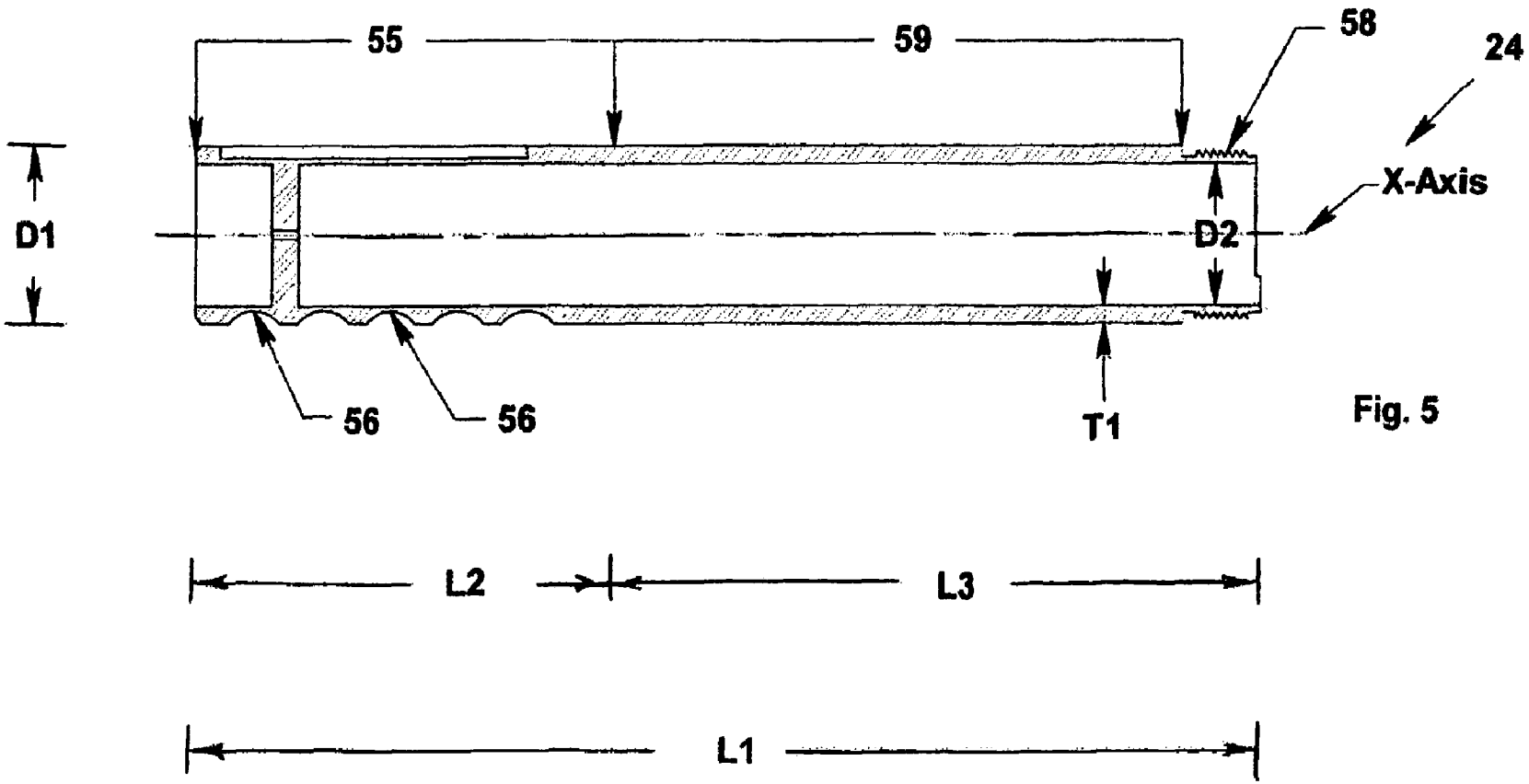
FIG. 5 is a side elevation view of the receiver extension tube with portions broken away.

Referring to FIG. 5, elongated receive extension tube 24 is seen to have a length L1, an outer diameter D1, an interior diameter D2, a longitudinally extending X-axis and a radial thickness T1. It also has a telescoping portion 55 with a plurality of transversely extending grooves 56 in its bottom surface. Its front end has external threads 58 for threading into mating internal threads in the rear end of a receiver. A passive portion 59 extends substantially from the rear end of external threads 58 to the front edge of telescoping portion 55. A closed cell foam tube 60 is telescopically received on passive portion 56. Telescoping portion 55 has a length L2 and passive portion 56 has a length L3.

The cap 48 of adjustment push button lock/screw 47 in its static position extends outwardly from the side wall surface of butt stock 22. Spring 51 draws tapered locking plunger pin 52 firmly into engagement with one of the transversely extending grooves 56 in the bottom surface of receiver extension tube 24. The tapering angle of the front end of locking plunger pin 52 would be mated to a similar taper in the respective transversely grooves 56 to eliminate slop or looseness in their engagement together. The top surface of receiver extension tube 24 has one or two axially extending alignment grooves 62 formed in its top surface that would align with the threaded alignment bore holes 33 in the top wall of butt stock 22. Stop pins 63 would be screwed downwardly into the threaded alignment bore holes 33 until they are pressed firmly against the top surface of the respective alignment grooves 62.

Figure 7:
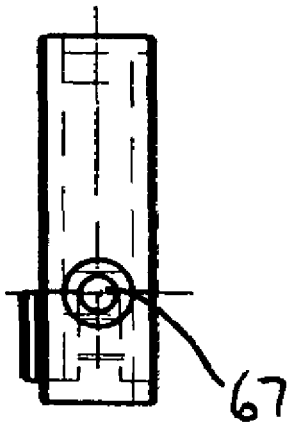
FIG. 7 is a left side elevation view of FIG. 6.
Figure 6:
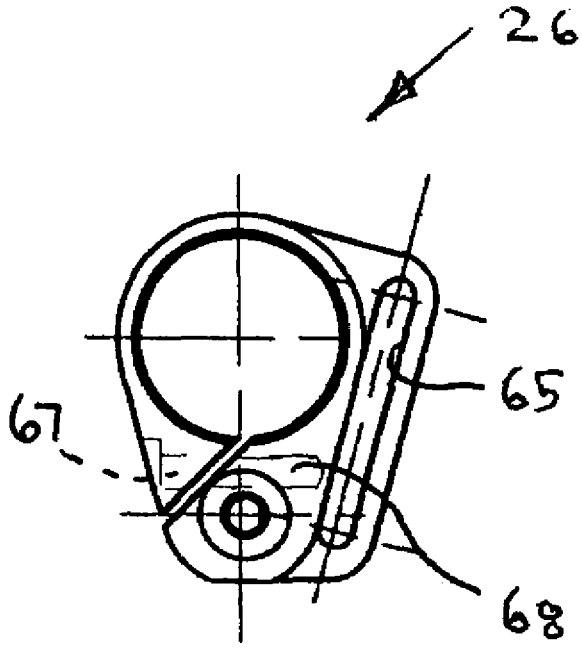
FIG. 6 is a front elevation view of the rotatable clamping gusset.

A rotatable split-ring clamping gusset/sling mount 26 is illustrated in FIGS. 6 and 7. It has an elongated upright slot 65 for receiving a web sling. A threaded bore 68 receives threaded clamp screw 67 for tightening the clamping gusset/sling mount 26 on receiver extension tube 24.

Figure 10:
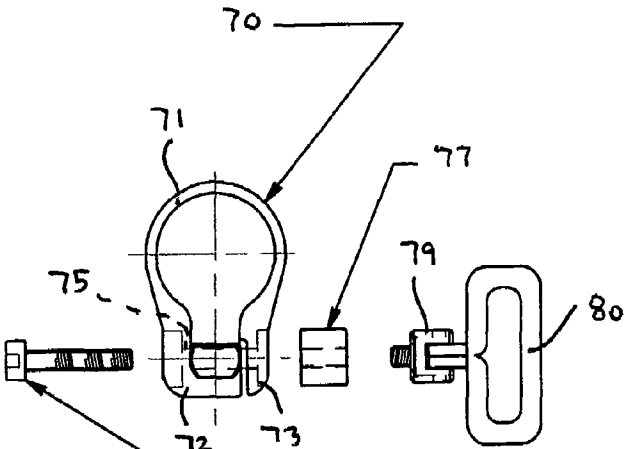
FIG. 10 is an exploded front elevation view of a first alternative embodiment clamping gusset/sling mount.

FIG. 10 illustrates an alternative embodiment clamping gusset 70 having an arcuate portion 71 and downwardly extending legs 72 and 73. A bore hole 75 passes through the respective legs 72 and 73 and a clamp screw 76 is inserted there through. A clamp nut/sling mount nut 77 is threaded on the end of clamp screw 76. An adapter nut 79 is also threaded into the outer end of clamp nut/sling mount nut 77. A 360 degree sling mount ring 80 is coupled to adapter nut 79.

Figure 13:
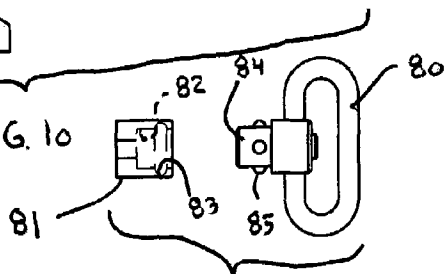
FIG. 13 is an exploded front elevation view of an alternative embodiment quick detachable sling mount.

A first alternative adapter nut 81 is illustrated in FIG. 13. It has a bore hole 82 in its outer end that has multiple recesses 83 around its interior. An adaptor pin 84 has a plurality of spring loaded balls 85 extending from its outer surface that snap into the respective recesses 83 to provide a quick detachable sling mount.

Figure 14:
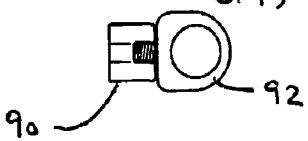
FIG. 14 is a front elevation view of a single hole type of sling mount.

FIG. 14 illustrates another adaptor nut 90 that would be threaded onto the end of clamp screw 76. It has a single hole type sling mount ring 92.

An alternative embodiment adjustable length butt stock assembly will now be described by referring to FIGS. 15-18. The adjustable length butt stock assembly is generally designated the numeral 94. Its major parts are butt stock 96, elongated receiver extension tube 98 and rotatable clamping gusset/sling mount 100. The top wall 102 of butt stock 96 has an upwardly extending ridge member 103 that has a sling mount slot 104 therein. Butt stock 96 has a front end having a primary bore hole 106 extending rearwardly therein. The rear end 108 of butt stock could have a trap door that hinges downwardly to allow items to be stored in the chamber within the butt stock. Bottom surface 110 has a cross hatched hammer surface. A tapped hole 111 may be formed in the bottom hammer surface 110 for mounting a Mono-Pod. A sling mount 113 is pivotally secured to the front end of the battle hammer 110.

Receiver extension tube 98 has a key 115 extending downwardly from its bottom surface and this extends from its rear end up to its external threads 117 adjacent its front end. Immediately rearwardly of external threads 117, receiver extension tube 98 has a tapered surface 119 that mates with the internal tapered surface of clamping gusset 100. A reversible sling mount 123 has a gusset clamp bolt that engages a threaded bore on clamping gusset on 100. A plurality of longitudinally spaced tapered bore holes 130 extend along a major portion of key 115. Tapped holes 132 are positioned between each respective bore hole 130 and a screw can be threaded into any of these tapped bore holes to provide a removable stock position stop that allows the receiver extension tube to be quickly adjusted for a particular shooter. A stock adjustment lever 136 is connected to an arm 138 that is captured above cap 140 of release pin 142. The front end of release pin 142 has a tapered plunger 144 that mates with the tapered bore holes 130 to eliminate any slop. Position adjustment numbers 150 are marked along the length of key 115. An adjustable cheek piece 160 is seen in FIGS. 15 and 17. Cheek piece 160 has an integrated foam-rubber pad that extends out over the clamping gusset 100 when the receiver extension tube 98 is fully collapsed in butt stock 96. It has a pair of vertical slots 162 that pass over screws 164 that are screwed into tapped holes (not shown). A second set of these tapped holes may be found on the other side of butt stock 96 to mount an optional extra storage compartment.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and the number and configuration of various vehicle components described above may be altered, all without departing from the spirit or scope of the invention as defined in the appended Claims.

What is claimed is:

1. An adjustable length butt stock assembly for a firearm comprising:

an elongated receiver extension tube having a front end, a rear end, a longitudinally extending X-axis, a telescoping portion extending forwardly a predetermined distance from said rear end, a passive portion extending rearwardly a predetermined distance from said front end; an outer diameter D1, an inner diameter D2; said receiver extension tube having a radial thickness T1 and a length L1;

said receiver extension tube having an outer top surface, an outer bottom surface, an outer left side surface and an outer right side surface;

a plurality of longitudinally spaced length adjustment grooves formed in said outer bottom surface of said receiver extension tube; said length adjustment grooves being transversely oriented to said X-axis;

a butt stock having a front end having a front wall surface, a rear end having a rear wall surface, a top wall surface, a bottom wall outer surface, a left side outer wall surface and a right side outer wall surface; a primary bore hole having a diameter greater than D1 extends inwardly from said front end of said butt stock for telescopically receiving said rear end of said receiver extension tube; a secondary bore hole extends traversely through said butt stock from said left side outer wall surface to said right side outer wall surface; said secondary bore hole having an interior outlet port that communicates with the interior of said primary bore hole;

an elongated locking plunger pin having an outer end, an inner end and an arcuate outer side wall surface wherein said inner end of said locking plunger pin has an internally threaded bore that matingly receives an externally threaded front end of a push button lock/screw; and said push button lock/screw having an outer end having a head cap, a shank portion and said externally threaded front end locking means for locking and unlocking said locking plunger pin in said secondary bore hole with a portion of said arcuate outer surface of said locking plunger pin extending through said interior outlet port so that said locking plunger pin engages one of said adjustment grooves formed in said outer bottom surface of said receiver extension tube wherein said locking means comprises a push button lock/screw.

2. An adjustable length butt stock assembly for a firearm as recited in claim 1 wherein said receiver extension tube has a cylindrical outer surface.

3. An adjustable length butt stock assembly for a firearm as recited in claim 1 further comprising attachment means adjacent said front end of said receiver extension tube for detachable connection to the rear end of a firearm receiver.

4. An adjustable length butt stock assembly for a firearm as recited in claim 3 wherein said attachment means are external threads on said outer surface of said receiver extension tube.

5. An adjustable length butt stock assembly for a firearm as recited in claim 3 further comprising a rotatable clamping gusset removably inserted on said receiver extension tube adjacent said front end for reinforcing said front end of said receiver extension tube adjacent said attachment means.

6. An adjustable length butt stock assembly for a firearm as recited in claim 5 wherein said clamping gusset has at least one elongated sling slot.

7. An adjustable length butt stock assembly for a firearm as recited in claim 1 further comprising at least one axially extending alignment groove formed in said outer top surface of said telescoping portion of said receiver extension tube.

8. An adjustable length butt stock assembly for a firearm as recited in claim 7 wherein said butt stock has at least one threaded alignment bore hole formed in said top wall outer surface; an alignment screw is threaded into said threaded alignment bore hole and down into said alignment groove on said outer top surface of said receiver extension tube.

9. An adjustable length butt stock assembly for a firearm as recited in claim 1 further comprising a cross-hatched hammer surface is formed on said bottom wall outer surface of said butt stock.

10. An adjustable length butt stock assembly for a firearm as recited in claim 1 further comprising a closed cell foam overtube that insulates the operator from said butt stock assembly and reduces operator felt vibration.

11. An adjustable length butt stock assembly for a firearm as recited in claim 1 wherein said butt stock has a laterally extended open window structure that forms a front strut frame member; and a pair of laterally spaced upright oriented spring grooves are formed in said front strut frame member.

12. An adjustable length butt stock assembly for a firearm as recited in claim 1 wherein T1 is at least 0.07 inch or greater which enables said stock assembly to be much stronger than current stock designs for the AR15 firearm.

13. An adjustable length butt stock assembly for a firearm as recited in claim 1 wherein said inner end of said locking plunger pin has a tapered outer side wall surface.

14. An adjustable length bun stock assembly for a firearm as recited in claim 13 wherein said length adjustment grooves are tapered to match said tapered outer side wall surface of said locking plunger pin to take the slop or play out of said licking means.

15. An adjustable length butt stock assembly for a firearm as recited in claim 1 further comprising a coil spring surrounding said shank portion of said push button lock/screw.

16. An adjustable length butt stock assembly for a firearm as recited in claim 15 wherein said secondary bore hole has a front end and a rear end; said front end has a countersink that forms a gate that reduces the chances of said locking plunger pin being accidentally released.

17. An adjustable length butt stock assembly for a firearm as recited in claim 1 further comprising audible signal means incorporated into said locking plunger pin and said length adjustment grooves in said outer surface of said receiver extension tube that creates an audible as well as tactile click when properly aligned.

* * * * *